US009607566B2

(12) United States Patent
Saito et al.

(10) Patent No.: US 9,607,566 B2
(45) Date of Patent: Mar. 28, 2017

(54) DISPLAY APPARATUS AND DISPLAY PANEL DRIVER INCLUDING SOFTWARE-CONTROLLED GATE WAVEFORMS

(71) Applicant: Synaptics Japan GK, Tokyo (JP)

(72) Inventors: Satoshi Saito, Tokyo (JP); Kota Kitamura, Tokyo (JP); Hajime Tanabe, Tokyo (JP)

(73) Assignee: SYNAPTICS JAPAN GK, Tokyo (JP)

( * ) Notice: Subject to any disclaimer, the term of this patent is extended or adjusted under 35 U.S.C. 154(b) by 83 days.

(21) Appl. No.: 14/229,657

(22) Filed: Mar. 28, 2014

(65) Prior Publication Data

US 2014/0313115 A1 Oct. 23, 2014

(30) Foreign Application Priority Data

Apr. 1, 2013 (JP) ..... 2013-076271

(51) Int. Cl.
*G09G 3/36* (2006.01)

(52) U.S. Cl.
CPC ..... *G09G 3/3677* (2013.01); *G09G 3/3648* (2013.01)

(58) Field of Classification Search
CPC .. G09G 3/3677; G09G 3/3674; G09G 3/3648; G09G 3/3696
See application file for complete search history.

(56) References Cited

U.S. PATENT DOCUMENTS 6,501,453 B1 * 12/2002 Wong ..... G09G 3/3677 345/90
2006/0227095 A1 * 10/2006 Kim ..... G09G 3/3659 345/100
2007/0091013 A1 * 4/2007 Pak ..... G02F 1/13338 345/50
2008/0143660 A1 6/2008 Itou
2008/0303765 A1 * 12/2008 Nakatsuka ..... G09G 3/3648 345/87
2008/0309601 A1 * 12/2008 Furukoshi ..... G09G 3/3648 345/89

(Continued)

FOREIGN PATENT DOCUMENTS

JP H01-231026 A 9/1989
JP 2001-147672 A 5/2001

(Continued)

OTHER PUBLICATIONS

Japanese Office Action dated Jan. 30, 2017 with an English translation.

*Primary Examiner* — Ariel Balaoing
*Assistant Examiner* — Darlene M Ritchie
(74) *Attorney, Agent, or Firm* — McGinn IP Law Group, PLLC.

(57) ABSTRACT

A liquid crystal display apparatus includes a liquid crystal display panel having gate lines and source lines, a GIP circuit which drives the gate lines and a source driver IC3 which drives the source lines. The source driver IC3 includes a gate control signal generator which generates gate control signals SOUT1-SOUTn which control the GIP circuit. The gate control signal generator is configured so that it is possible to control the waveforms of the gate control signals SOUT1-SOUTn in software.

6 Claims, 18 Drawing Sheets

(56) References Cited

U.S. PATENT DOCUMENTS

| | | | | |
|---|---|---|---|---|
| 2010/0141850 | A1* | 6/2010 | Itoh | G09G 3/3677 348/731 |
| 2011/0169796 | A1* | 7/2011 | Guo | G09G 3/3677 345/208 |
| 2013/0063404 | A1* | 3/2013 | Jamshidi Roudbari | G06F 3/044 345/204 |
| 2014/0022185 | A1* | 1/2014 | Ribeiro | G06F 3/0412 345/173 |
| 2014/0062985 | A1* | 3/2014 | Shin | G09G 3/3677 345/212 |
| 2014/0063379 | A1* | 3/2014 | Seo | G02B 27/225 349/15 |
| 2014/0104248 | A1* | 4/2014 | Won | G09G 5/00 345/204 |
| 2014/0168186 | A1* | 6/2014 | Kang | G09G 3/3648 345/212 |
| 2014/0218346 | A1* | 8/2014 | Huang | G09G 3/3677 345/208 |
| 2014/0266995 | A1* | 9/2014 | Cho | G09G 3/3607 345/88 |
| 2014/0292722 | A1* | 10/2014 | Hong | G06F 3/042 345/175 |
| 2015/0279272 | A1* | 10/2015 | Takahara | G09G 3/3233 345/76 |

FOREIGN PATENT DOCUMENTS

| | | | |
|---|---|---|---|
| JP | 2008-151940 | A | 7/2008 |
| JP | 2010-117492 | A | 5/2010 |

* cited by examiner

DISPLAY APPARATUS AND DISPLAY PANEL DRIVER INCLUDING SOFTWARE-CONTROLLED GATE WAVEFORMS

CROSS REFERENCE

This application claims a priority on convention based on Japanese Patent Application No. JP 2013-076271. The disclosure thereof is incorporated herein by reference.

TECHNICAL FIELD

The present invention relates to a display panel driver and a display apparatus, and more particularly relates to a display panel driver that has a function of controlling a circuit which drives gate lines (also, to be referred to as scanning lines or address lines) of a display panel, and a display apparatus that uses the display panel driver.

BACKGROUND ART

Display panels such as a liquid crystal display apparatus typically include gate lines (also, to be referred to as scanning lines or address lines) for selecting a row of pixels and source lines (also, to be referred to as signal lines or data lines) to which a signal corresponding to image data showing a gradation of each pixel. For this reason, a driver (sometimes, to be referred to as a gate driver) for driving the gate lines and a driver (sometimes, to be referred to as a source driver) for driving the source lines are assembled in a panel display apparatus that contains the display panel.

One example of the panel display apparatus is configured such that a function of generating a control signal (gate control signal) which controls a gate driver for driving a gate line is assembled in an integrated circuit (IC) which functions as a source driver, and the generated control signal is supplied to the gate driver through wirings integrated in a display panel. At this time, the gate driver may be integrated on a glass substrate of the display panel by using a COG (circuit on glass) technique (hereinafter, the gate driver is sometimes referred to as a GIP (gate in panel) circuit). Also, an IC chip functioning as the gate driver may be joined to the display panel. Such configuration is preferable because a signal is not required to be supplied to the gate driver from outside the display panel and the number of the signal lines connected to the display panel can be reduced. The panel display apparatus configured in this way is disclosed in, for example, JP 2008-224798A and JP 2012-181543A.

CITATION LIST

[Patent Literature 1]: JP 2008-224798A
[Patent Literature 2]: JP 2012-181543A

SUMMARY OF THE INVENTION

One problem which the inventor recognized about such a panel display unit is in that a control system for driving the gate lines may be different for every manufacturer of the display panel or gate driver IC or for every product. The waveforms of a control signal which controls a GIP circuit or a gate driver IC (gate control signal) are different, depending on the specification of the display panel or the gate driver IC. However, it is not economical to manufacture a source driver IC of an exclusive use corresponding to the specification of each manufacturer or each product.

As one measurement corresponding to the above problem, a plurality of hardware circuits for the specifications of respective manufacturers are integrated in the source driver IC and an actually validated hardware circuit is selected (e.g. to be selected through the setting). However, in such a measurement, many hardware circuits of exclusive use are required when the number of manufacturers or products to be dealt with increases, and the circuit scale and the design man-day increases. Also, because a hardware circuit is used, it is difficult to deal with a new design specification after design completion, and it becomes difficult to measure a specification change.

Therefore, an object of the present invention is to provide a display panel driver which can generate a gate control signal which measures a gate driver (a GIP circuit or a gate driver IC) of different specification while reducing a circuit scale.

According to an aspect of the present invention, a display apparatus includes: a display panel comprising gate lines and source lines; a gate driver configured to drive each of the gate lines; and a source driver configured to drive each of the source lines. The source driver includes a gate control signal generator configured to generate a gate control signal to control the gate driver, and wherein the gate control signal generator is configured to allow a waveform of the gate control signal to be controlled in software.

Here, the gate driver may be integrated on the substrate of the display panel. Also, the gate driver may be the gate driver IC integrated in the semiconductor chip. In this case, the gate driver IC may be mounted into the display panel.

A display panel driver includes: a source driver circuit section configured to drive source lines of a display panel; and a gate control signal generating section configured to generate a gate control signal to control a gate driver which drives a gate line of said display panel. The gate control signal generating section is configured to be able to control a waveform of the gate control signal in software.

According to the present invention, the source driver can be provided such that the gate control signal can be generated to conform to the gate driver (the GIP circuit or the gate driver IC) of a different specification while reducing a circuit scale.

DESCRIPTION OF EMBODIMENTS

First Embodiment

Figure 1:
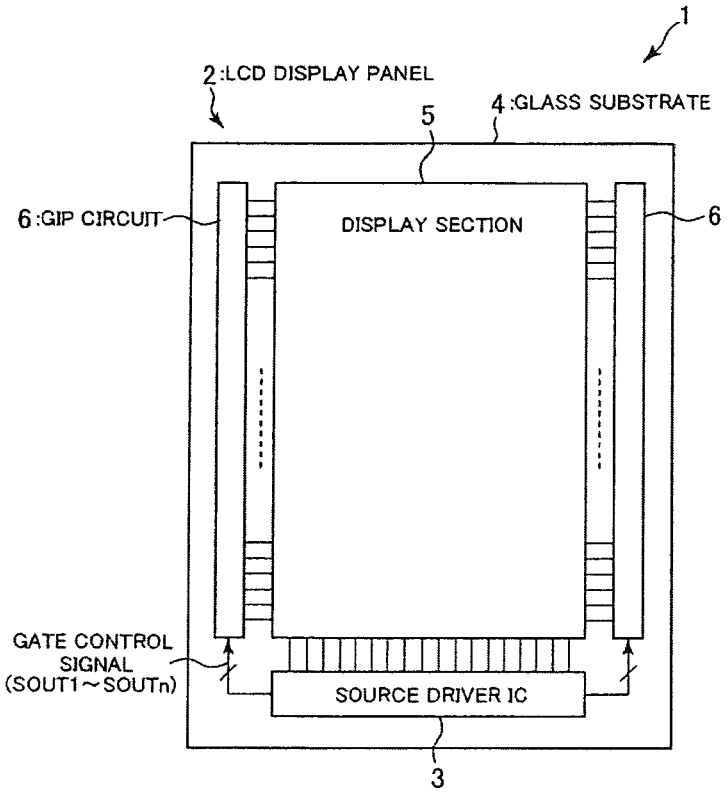
FIG. 1 is a conceptual diagram showing an example of a configuration of a liquid crystal display apparatus according to a first embodiment of the present invention.

FIG. 1 is a conceptual diagram showing an example of the configuration of a liquid crystal display apparatus 1 according to a first embodiment of the present invention. The liquid crystal display apparatus 1 contains a liquid crystal display panel 2 and a source driver IC 3. A display section 5 and a GIP (gate in panel) circuit 6 are formed on a glass substrate 4 of the liquid crystal display panel 2. Gate lines (also, referred to as scanning lines or address lines), source lines and pixels are integrated on the display section 5. The GIP circuit 6 is a circuit for driving the gate lines of the display section 5 and is formed on the glass substrate 4 by using the COG (circuit on glass) technique, for example.

The source driver IC 3 has a function as a display panel driver for driving the source lines disposed on the display section 5 of the liquid crystal display panel 2. In addition, the source driver IC 3 also has a function of supplying gate control signals SOUT1 to SOUTn to the GIP circuit 6. The GIP circuit 6 drives the gate lines of the display section 5 in response to the gate control signals SOUT1 to SOUTn supplied by the source driver IC 3.

Figure 2:
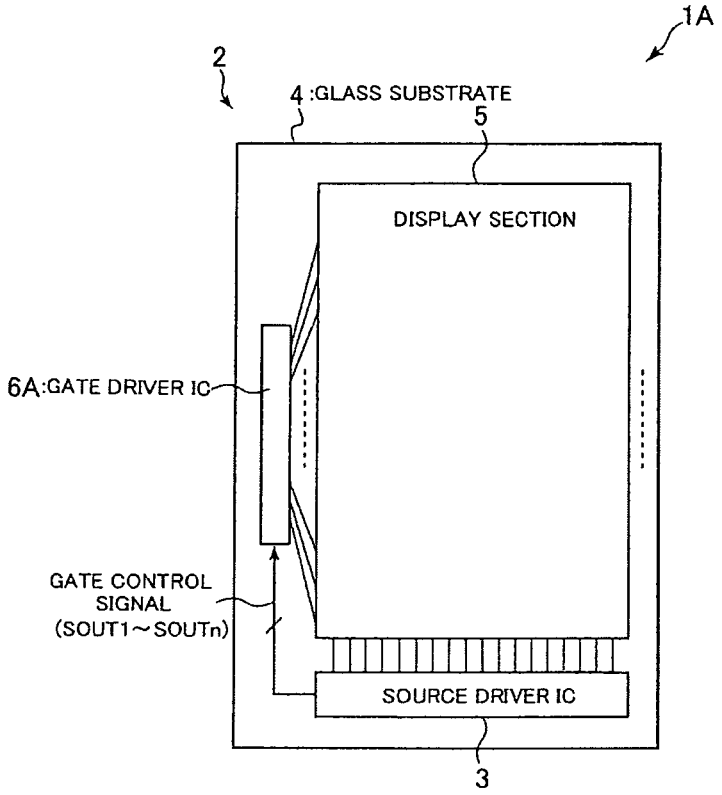
FIG. 2 is a conceptual diagram showing another example of the configuration of the liquid crystal display apparatus in the first embodiment.

In the configuration of FIG. 1, the gate lines are driven by the GIP circuits 6 integrated on the liquid crystal display panel 2. However, as shown in FIG. 2, a gate driver IC 6A integrated as a semiconductor chip may be mounted on the liquid crystal display panel 2 to drive the gate lines of the display section 5. In this case, the gate driver IC 6A drives the gate lines of the display section 5 in response to the gate control signals SOUT1 to SOUTn supplied by the source driver IC 3.

As mentioned above, a design specification of the GIP circuit 6 (FIG. 1) and a design specification of the gate driver IC 6A (FIG. 2), namely, the gate control signals SOUT1 to SOUTn to be supplied are different depending on a maker or a product. In order to deal with such a problem, the source driver IC 3 in the present embodiment is configured such that the waveforms of the gate control signals SOUT1 to SOUTn can be programmed in software. The source driver IC 3 configured as mentioned above can generate the gate control signals SOUT1 to SOUTn having the waveforms corresponding to the GIP circuit 6 or gate driver IC 6A of various specifications. The configuration of the source driver IC 3 will be described below in detail.

Figure 3:
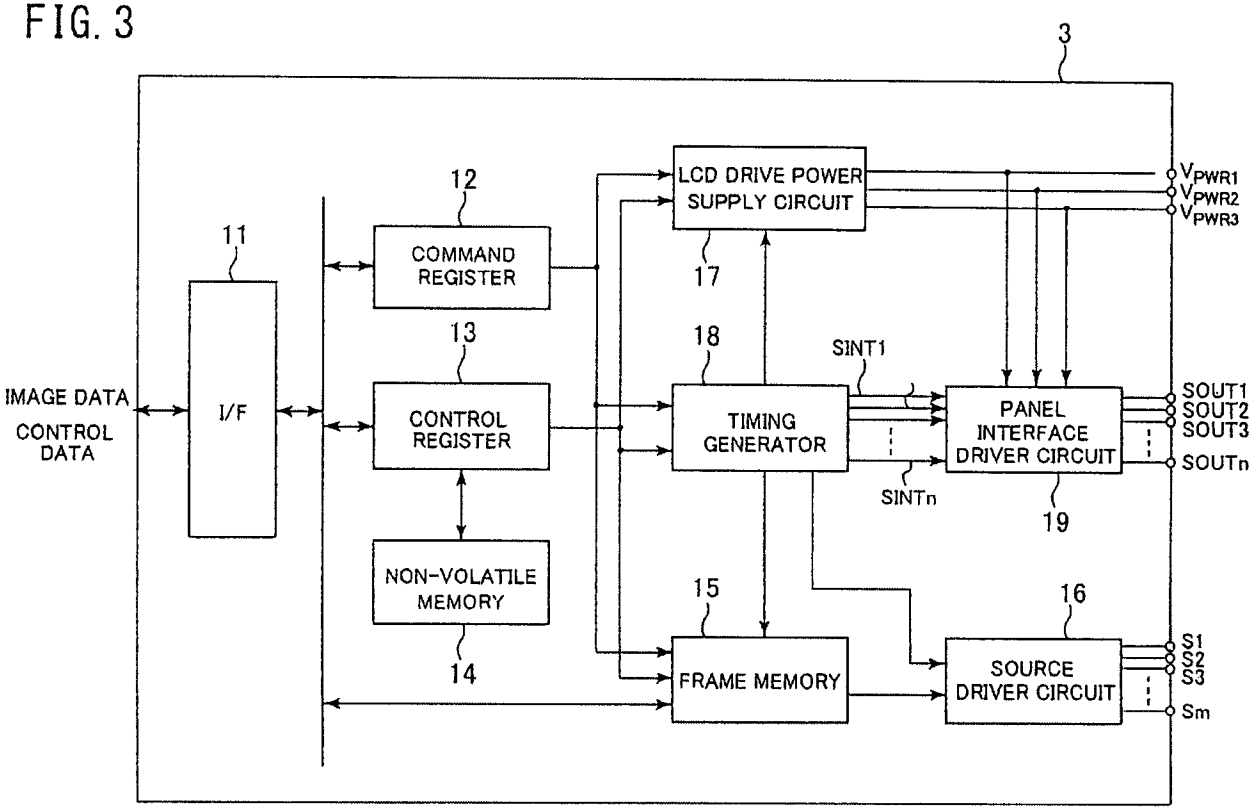
FIG. 3 is a block diagram showing a configuration of a source driver IC in the first embodiment.

FIG. 3 is a block diagram showing the configuration of the source driver IC 3 in the present embodiment. The source driver IC 3 in the present embodiment contains an interface 11, a command register 12, a control register 13, a non-volatile memory 14, a frame memory 15, a source driver circuit 16, an LCD drive power supply circuit 17, a timing generator 18 and a panel interface driver circuit 19.

The interface 11 is a circuit for receiving image data and control data from an external apparatus (for example, a host processor) and transmitting data generated by the source driver IC 3 to the external apparatus.

The command register 12, the control register 13 and the non-volatile memory 14 configure a circuit group for storing data used to control the source driver IC 3. The command register 12 stores a command included in the control data received from the external apparatus, and the control register 13 stores register values used to control the source driver IC 3. The frame memory 15, the LCD drive power supply circuit 17 and the timing generator 18 operate in response to the command stored in the command register 12 and the register values stored in the control register 13. The non-volatile memory 14 stores the register values that are initially set in the control register 13 (for example, set at the time of startup of the source driver IC 3) in a non-volatile manner. When the source driver IC 3 is started up, the register values stored in the non-volatile memory 14 are read and stored in the control register 13. The register values stored in the control register 13 and the non-volatile memory 14 can be re-written through the interface 11 from the external apparatus.

The frame memory 15 and the source driver circuit 16 configure a circuit portion for driving the source lines disposed on the display section 5. The frame memory 15 stores image data supplied from the external apparatus. The source driver circuit 16 generates source drive signals S1 to Sm in response to the image data read from the frame memory 15. The source drive signals S1 to Sm are supplied to the m source lines of the display section 5 and written into the pixels which are connected to the gate line selected by the GIP circuit 6 or gate driver IC 6A through the m source lines.

The LCD drive power supply circuit 17 generates various power supply voltages used in the source driver IC 3. In the present embodiment, the LCD drive power supply circuit 17 also has a function of generating the power supply voltages $V_{PWR1}$ to $V_{PWR3}$ to be supplied to the GIP circuit 6 or gate driver IC 6A. The operation of the LCD drive power supply circuit 17 is controlled in response to a command stored in the command register 12 and the register values stored in the control register 13.

The timing generator 18 is a circuit for carrying out the timing control of the respective circuits included in the source driver IC 3. The timing generator 18 supplies signals to the frame memory 15, the source driver circuit 16 and the LCD drive power supply circuit 17 to control the operation timing of them.

In addition, the timing generator 18 also has a function of carrying out the timing control of the GIP circuit 6 or gate driver IC 6A. In detail, in the present embodiment, the timing generator 18 supplies internal gate control signals SINT1 to SINTn to the panel interface driver circuit 19, and the gate control signals SOUT1 to SOUTn are generated from internal gate control signals SINT1 to SINTn.

The panel interface driver circuit 19 operates as a level shifter which performs a level shift operation on the internal gate control signals SINT1 to SINTn so as to make the signal levels match to the input signal level of the GIP circuit 6 or gate driver IC 6A, and outputs the signals after the level shift as the gate control signals SOUT1 to SOUTn. That is, the gate control signals SOUT1 to SOUTn are generated as signals which are different in amplitude from the internal gate control signals SINT1 to SINTn although having same waveforms as those of the internal gate control signals SINT1 to SINTn.

Figure 4:
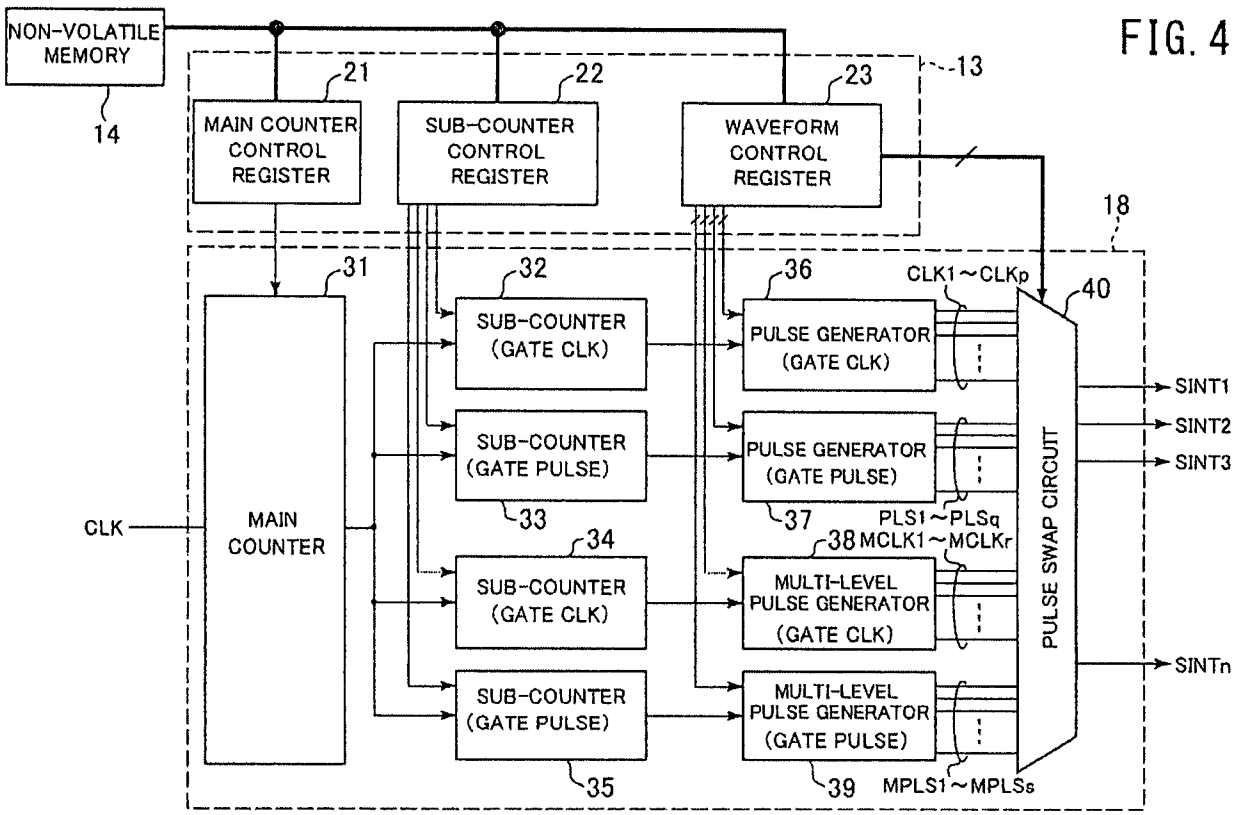
FIG. 4 is a block diagram showing a configuration of a portion related to generation of internal gate control signals SINT1 to SINTn in the source driver IC in the first embodiment.

FIG. 4 shows the configuration of a circuit portion (internal gate control signal generating section) that is related to the generation of the internal gate control signals SINT1 to SINTn. The circuit portion shown in FIG. 4 and the above panel interface driver circuit 19 configure a gate control signal generating section for generating the gate control signals SOUT1 to SOUTn.

In the source driver IC 3 of the present embodiment, the waveforms of the internal gate control signals SINT1 to SINTn, namely, the waveforms of the gate control signals SOUT1 to SOUTn can be programmed in software. In detail, it is possible to adjust the waveforms of the internal gate control signals SINT1 to SINTn by setting the register values in the registers included in the control register 13.

In detail, the control register 13 contains a main counter control register 21, a sub-counter control register 22 and a waveform control register 23. The timing generator 18 contains a main counter 31, sub-counters 32 to 35, pulse generators 36 and 37, multi-level pulse generators 38 and 39 and a pulse swap circuit 40.

The main counter 31 carries out an operation of counting pulses of a clock signal CLK in response to a register value held by the main counter control register 21. In the present embodiment, the main counter control register 21 holds the register value that indicates the number of pulses of the clock signal CLK that is to be counted up by the main counter 31 (increases the count value by "1"). In this case, the main counter 31 counts up at a speed corresponding to the register value held by the main counter control register 21.

Each of the sub-counters 32 to 35 carries out an operation of counting a change in the counter value of the main counter 31 in response to a register value held by the sub-counter control register 22. In the present embodiment, the sub-counter control register 22 holds the register value that indicates a change amount of the counter value of the main counter 31, which is counted up by the sub-counters 32 to 35 (increases the count value by "1"). In this case, each of the sub-counters 32 to 35 counts up at a speed corresponding to the register value held by the sub-counter control register 22.

Figure 5:
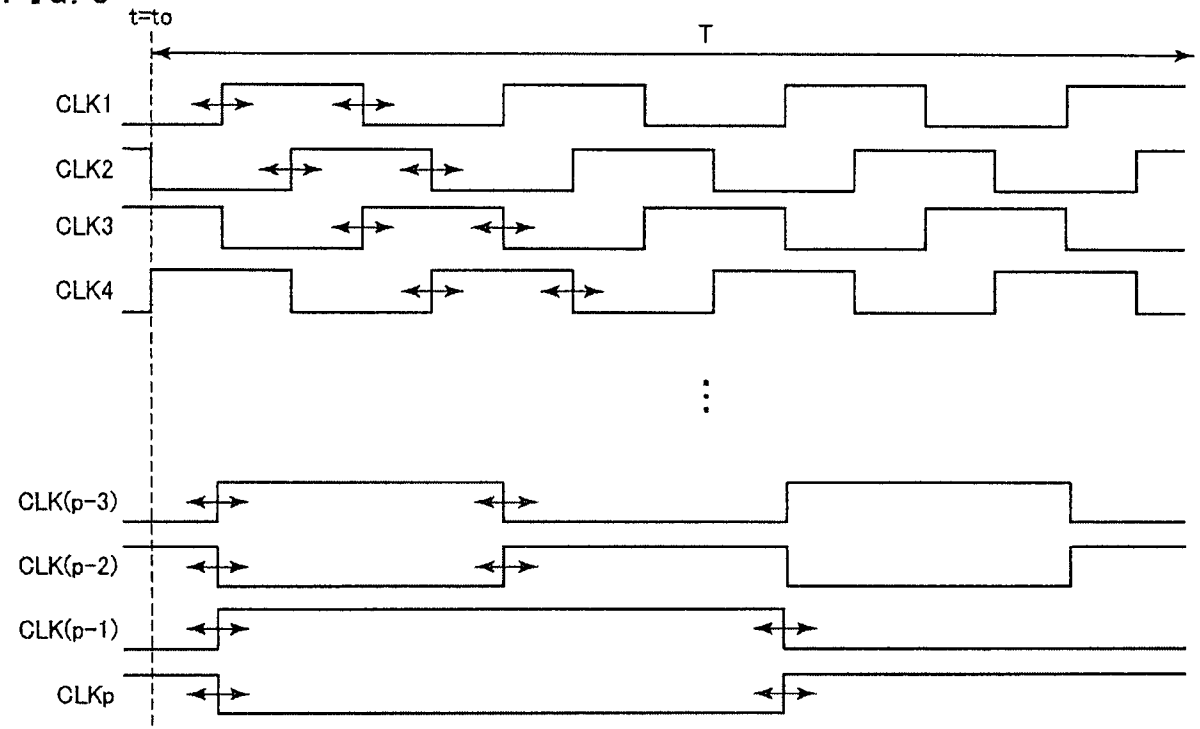
FIG. 5 is a timing chart showing an example of a waveform of an internal clock signal generated by a pulse generator in the first embodiment.

The pulse generators 36 and 37 function as an internal digital signal generating section controlled on the basis of a register value held by the waveform control register 23 and generating a group of internal digital signals having different waveforms. In detail, the pulse generator 36 generates internal clock signals CLK1 to CLKp (p is an integer of 2 or more) while referring to the register value held by the waveform control register 23 and the counter value of the sub-counter 32. FIG. 5 shows an example of the waveforms of the internal clock signals CLK1 to CLKp generated by the pulse generator 36. The pulse generator 36 can generate the internal clock signals different in phase from each other and can generate the internal clock signals different in period differ from each other. That is, with regard to the internal clock signals CLK1 to CLKp, their periods and phases can be adjusted.

Referring to FIG. 4 again, the internal clock signals CLK1 to CLKp are generated by the pulse generator 36 as one example as follows. The register value to set the period and phase of each of the internal clock signals CLK1 to CLKp is set in the waveform control register 23. The pulse generator 36 compares the set register value with the counter value of the sub-counter 32 and sets each of the internal clock signals CLK1 to CLKp to a high level or a low level on the basis of the result of the comparison. By suitably setting the register value in the waveform control register 23, it is possible to adjust the period and phase of each of the internal clock signals CLK1 to CLKp.

Figure 6:
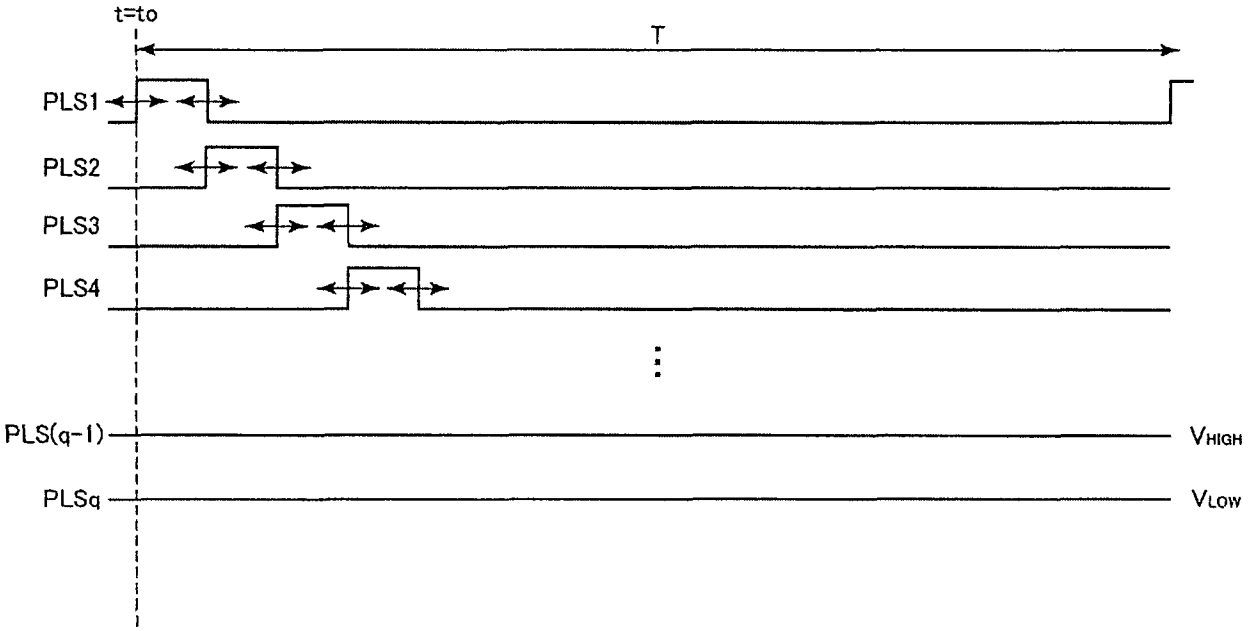
FIG. 6 is a timing chart showing an example of the waveform of the internal clock signal generated by the pulse generator in the first embodiment.

Similarly, the pulse generator 37 generates internal pulse signals PLS1 to PLSq (q is an integer of 2 or more) while referring to the register value held by the waveform control register 23 and the counter value of the sub-counter 33. FIG. 6 shows an example of the waveforms of the internal pulse signals PLS1 to PLSq generated by the pulse generator 37. The pulse generator 37 can generate the internal pulse signals different in phase from each other, the internal pulse signals different in period from each other and the internal pulse signals different in duty ratio from each other. That is, with regard to the internal pulse signals PLS1 to PLSq, their periods, phases and duty ratios can be adjusted.

Referring to FIG. 4 again, the internal pulse signals PLS1 to PLSq are generated by the pulse generator 37 as one example as follows. The register value to determine the period and phase of each of the internal pulse signals PLS1 to PLSq is set in the waveform control register 23. The pulse generator 37 compares the set register value with the counter value of the sub-counter 33 and sets each of the internal pulse signals PLS1 to PLSq to the high level or the low level on the basis of the result of the comparison. By suitably adjusting the register value set in the waveform control register 23, it is possible to adjust the period, phase and duty ratio of each of the internal pulse signals PLS1 to PLSq.

Note that as the internal pulse signals PLS1 to PLSq, the signal in the high level may be always generated (in FIG. 6, the internal pulse signal PLS (q−1)). Also, the signal of the low level may be always generated (in FIG. 6, the internal pulse signal PLSq).

Also, note that the internal clock signals CLK1 to CLKp and the internal pulse signals PLS1 to PLSq are different only in at least one of the period, the phase and the duty ratio. Thus, attention should be paid to a fact that there is no essential difference as the digital signal.

Also, both of the multi-level pulse generators 38 and 39 function as multi-level internal digital signal generating sections, which are controlled on the basis of the register values held by the waveform control register 23 and generate a group of multi-level internal digital signals having different waveforms. Here, each of the multi-level internal digital signals is a signal that has three or more allowable signal levels. In the present embodiment, the multi-level internal digital signal of three values is generated.

In detail, the multi-level pulse generator 38 generates multi-level internal clock signals MCLK1 to MCLKr (r is an integer of 2 or more) while referring to the register values held by the waveform control register 23 and the counter values of the sub-counter 34. Each of the multi-level internal clock signals MCLK1 to MCLKr is a clock signal that has the three or more allowable signal levels. In the present embodiment, each of the multi-level internal clock signals MCLK1 to MCLKr is generated as a 3-valued clock signal.

Figure 7:
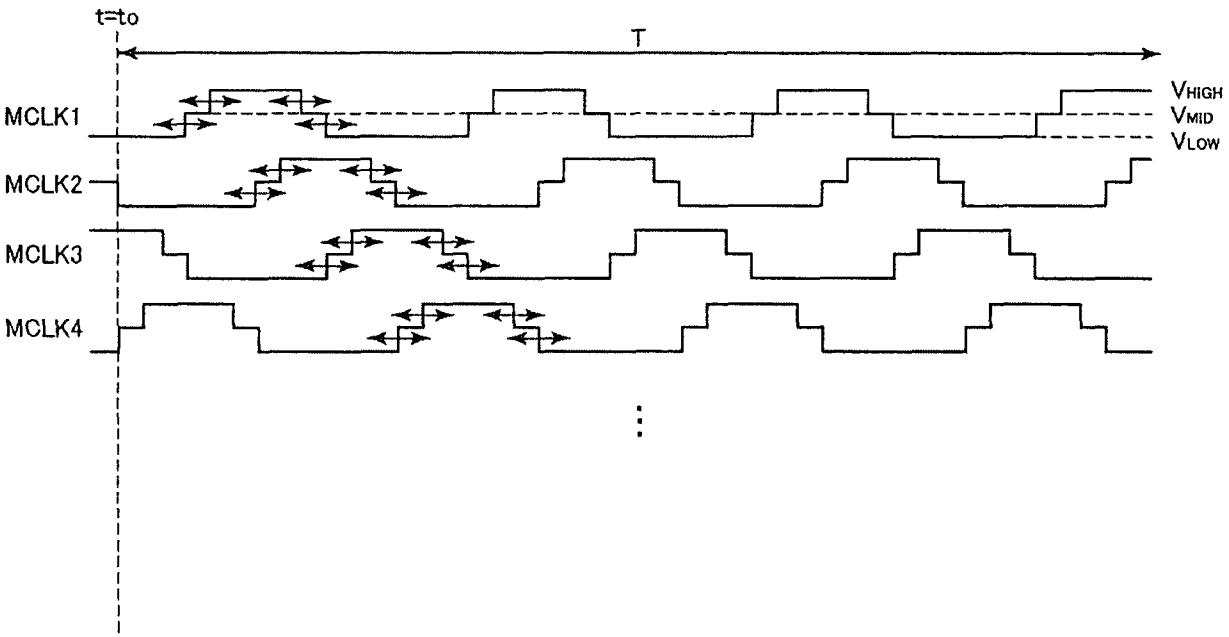
FIG. 7 is a timing chart showing an example of a waveform of a multi-level internal clock signal generated by a multi-level pulse generator in the first embodiment.

FIG. 7 shows an example of the waveforms of the multi-level internal clock signals MCLK1 to MCLKr generated by the multi-level pulse generator 38. The signal levels allowable for each of the multi-level internal clock signals MCLK1 to MCLKr are the three values of $V_{HIGH}$, $V_{MID}$ and $V_{LOW}$. Here, the voltage $V_{HIGH}$ is a voltage that is used as the internal clock signals CLK1 to CLKp and the internal pulse signals PLS1 to PLSq, and the voltage $V_{LOW}$ is the voltage that is used as the low level of the internal clock signals CLK1 to CLKp and the internal pulse signals PLS1 to PLSq. Also, the voltage $V_{MID}$ is a middle voltage between the voltages $V_{HIGH}$ and $V_{LOW}$. Each of the multi-level internal clock signals MCLK1 to MCLKr has a waveform that is kept at a middle level (the voltage $V_{MID}$) for a constant time in a course while each of them is shifted between the low level (the voltage and the high level (the voltage $V_{HIGH}$). The multi-level pulse generator 38 can generate the multi-level internal clock signals of different phases and can generate the multi-level internal clock signals of different periods. That is, with regard to the multi-level internal clock signals MCLK1 to MCLKr, their periods and phases can be adjusted. Also, in each of the multi-level internal clock signals MCLK1 to MCLKr, a length of a time while each of them is kept at the voltage $V_{MID}$ can be adjusted.

Referring to FIG. 4 again, the multi-level internal clock signals MCLK1 to MCLKr are generated by the multi-level pulse generator 38 as follows. The register values to determine each period and phase of the multi-level pulse generator 38 and the length of the time while keeping at the voltage $V_{MID}$ are set in the waveform control register 23. The multi-level pulse generator 38 compares the set register value with the counter value of the sub-counter 32, and sets each of the multi-level internal clock signals MCLK1 to MCLKr to the high level, low level or middle level on the basis of the result of the comparison. By suitably adjusting the register value set in the waveform control register 23, it is possible to adjust the period and phase of each of the multi-level internal clock signals MCLK1 to MCLKr and the length of the time while each of them is kept at the voltage $V_{MID}$.

Similarly, the multi-level pulse generator 39 generates multi-level internal pulse signals MPLS1 to MPLSs (s is an integer of 2 or more) while referring to the register values held by the waveform control register 23 and the counter values of the sub-counter 35. Each of the multi-level internal pulse signals MPLS1 to MPLSs is the pulse signal having the three or more allowable signal levels. In the present embodiment, each of the multi-level internal pulse signals MPLS1 to MPLSs is generated as a 3-valued pulse signal.

Figure 8:
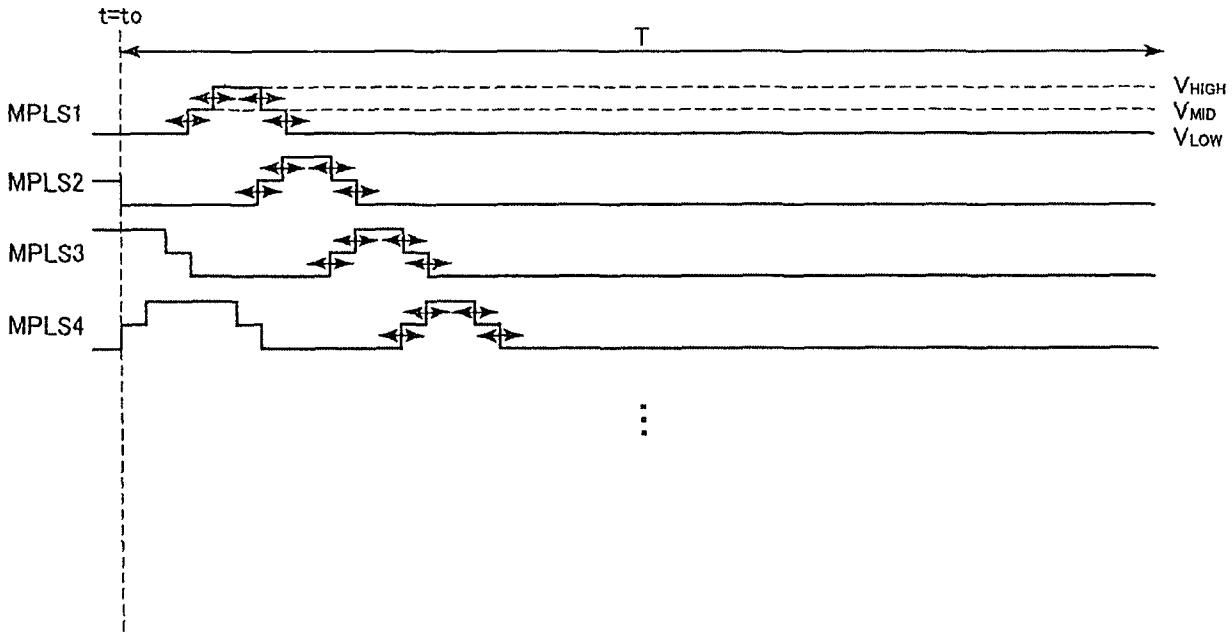
FIG. 8 is a timing chart showing an example of the waveform of the multi-level internal clock signal generated by the multi-level pulse generator in the first embodiment.

FIG. 8 shows an example of the waveforms of the multi-level internal pulse signals MPLS1 to MPLSs generated by the multi-level pulse generator 39. The signal levels allowable for each of the multi-level internal pulse signals MPLS1 to MPLSs are the three values of $V_{HIGH}$, $V_{MID}$ and $V_{LOW}$. Each of the multi-level internal pulse signals MPLS1 to MPLSs has a waveform that is kept at the middle level (the voltage $V_{MID}$) for a constant time in a course while each of them is shifted between the low level (the voltage $V_{LOW}$) and the high level (the voltage $V_{HIGH}$). The multi-level pulse generator 38 can generate the multi-level internal clock signals of different phases and can generate the multi-level internal clock signals of different periods. That is, with regard to the multi-level internal pulse signals MPLS1 to MPLSs, their periods and phases can be adjusted. Also, in each of the multi-level internal pulse signals MPLS1 to MPLSs, a length of a time while each of them is kept at the voltage $V_{MID}$ can be also adjusted.

The multi-level internal pulse signals MPLS1 to MPLSs are generated by the multi-level pulse generator 39 as follows. The register values to determine the period, phase and the length of the time to be kept at the voltage $V_{MID}$ for the multi-level pulse generator 39 are set in the waveform control register 23. The multi-level pulse generator 39 compares the set register values with the counter values of the sub-counter 32, and sets each of the multi-level internal pulse signals MPLS1 to MPLSs to the high level, low level or middle level on the basis of the result of the comparison. By suitably adjusting the register values set for the waveform control register 23, it is possible to adjust the period, the phase and the length of the time to be kept at the voltage $V_{MID}$ in each of the multi-level internal pulse signals MPLS1 to MPLSs.

Note that the multi-level internal clock signals MCLK1 to MCLKr and the multi-level internal pulse signals MPLS1 to MPLSs are different only in at least one of the period, the phase, and the duty ratio. Thus, attention should be paid to a fact that there is no essential difference as the multi-level signal (3-valued signal).

The pulse swap circuit 40 generates internal gate control signals SINT1 to SINTn from the internal clock signals CLK1 to CLKp, the internal pulse signals PLS1 to PLSq, the multi-level internal clock signals MCLK1 to MCLKr and the multi-level internal pulse signals MPLS1 to MPLSs. The internal gate control signals SINT1 to SINTn can be generated by various operations. Each internal gate control signal SINTi may be selected from the internal clock signals CLK1 to CLKp, the internal pulse signals PLS1 to PLSq, the multi-level internal clock signals MCLK1 to MCLKr and the multi-level internal pulse signals MPLS1 to MPLSs. Here, a same signal may be used as two or more signals among the internal gate control signals SINT1 to SINTn.

Also, each internal gate control signal SINTi may be generated as a signal obtained when a logical operation (for example, AND, OR, NAND, NOR or XOR) is performed on a plurality of signals among the internal clock signals CLK1 to CLKp, the internal pulse signals PLS1 to PLSq, the multi-level internal clock signals MCLK1 to MCLKr and the multi-level internal pulse signals MPLS1 to MPLSs.

The register values to control an operation of the pulse swap circuit 40 are set in the waveform control register 23. The pulse swap circuit 40 carries out the operation based on the set register values and generates each of the internal gate control signals SINT1 to SINTn. In detail, the pulse swap circuit 40 outputs a signal selected from the internal clock signals CLK1 to CLKp, the internal pulse signals PLS1 to PLSq, the multi-level internal clock signals MCLK1 to MCLKr and the multi-level internal pulse signals MPLS1 to MPLSs, or a signal obtained as a result of a logic operation of a plurality of signals among the above-mentioned signals as the internal gate control signals SINT1 to SINTn, in response to the set register values.

The generated internal gate control signals SINT1 to SINTn are supplied to the panel interface driver circuit 19. The panel interface driver circuit 19 converts the internal gate control signals SINT1 to SINTn to signals that have the signal levels corresponding to the input levels of the GIP circuit 6 or gate driver IC 6A, to generate the gate control signals SOUT1 to SOUTn. As one example, when the high level of the internal gate control signals SINT1 to SINTn is 5 V, the low level thereof is 0V and the middle level thereof is 2.5 V, the internal gate control signals SINT1 to SINTn are converted into the signals in which the high level is 15 V, the low level is 0 V and the middle level is 7.5 V, so as to generate the gate control signals SOUT1 to SOUTn. The generated gate control signals SOUT1 to SOUTn are supplied to the GIP circuit 6 or the gate driver IC 6A.

Figure 9:
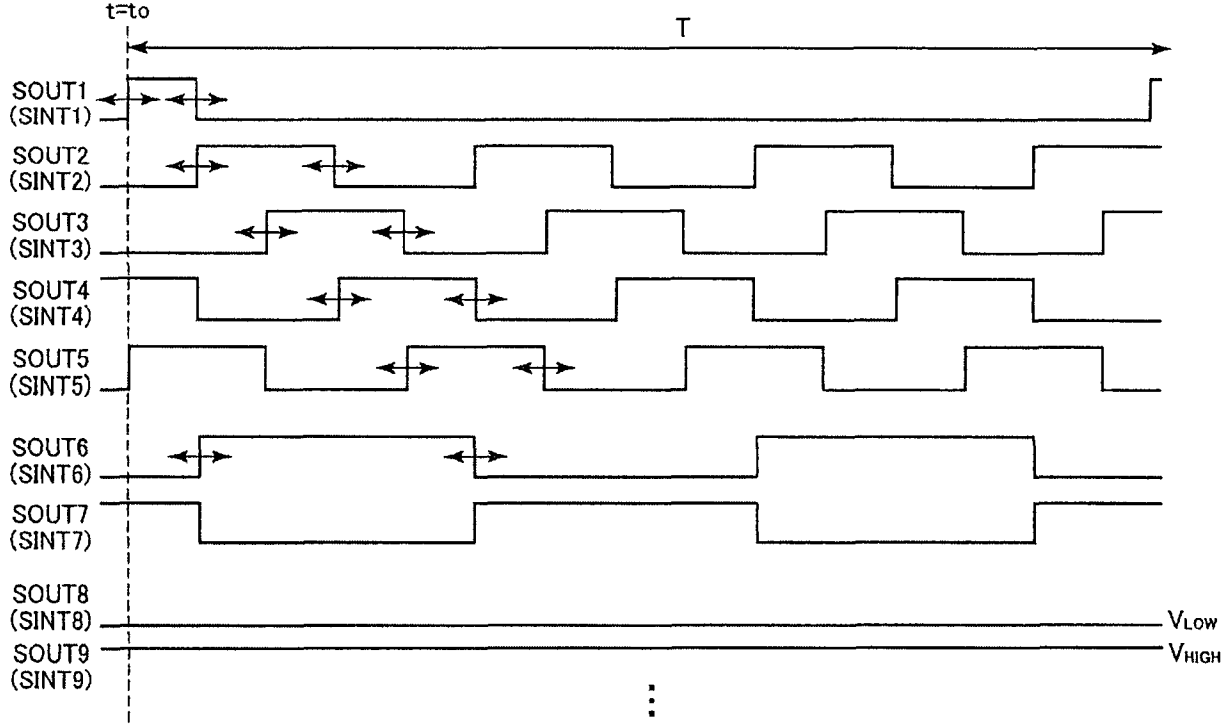
FIG. 9 is a timing chart showing an example of waveforms of gate control signals SOUT1 to SOUT9 generated by the source driver IC in the first embodiment.
Figure 10:
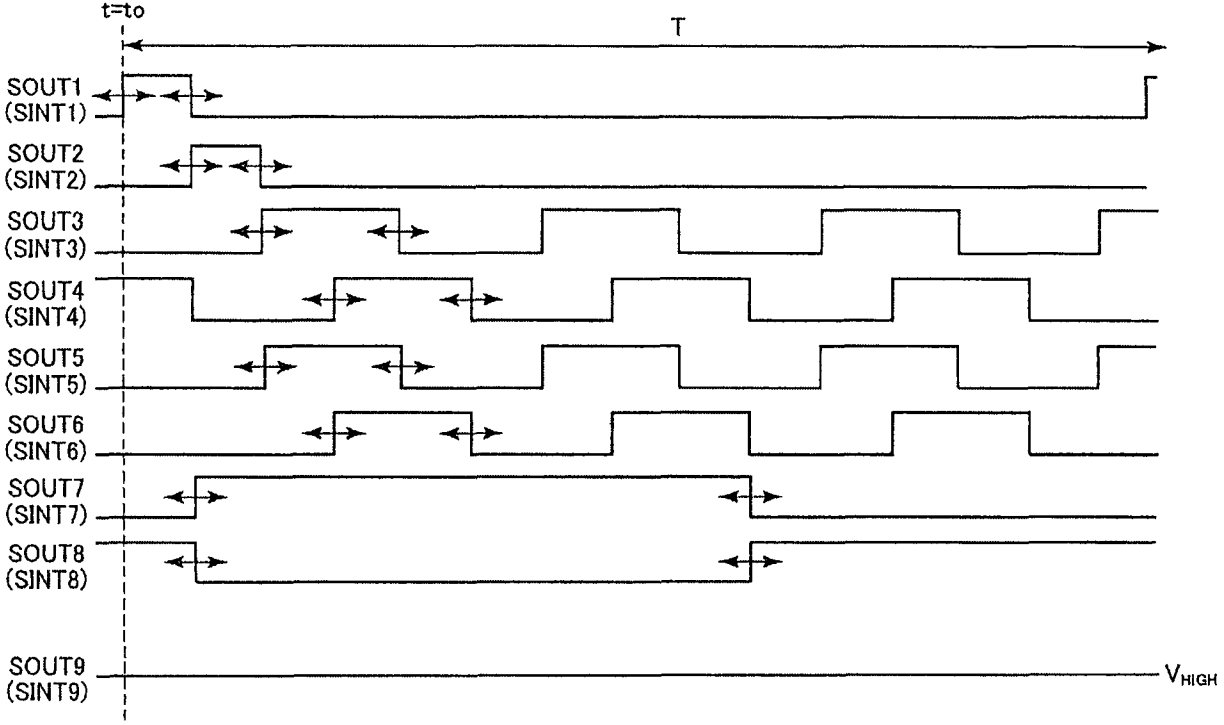
FIG. 10 is a timing chart showing an example of the waveforms of the gate control signals SOUT1 to SOUT9 generated by the source driver IC in the first embodiment.
Figure 11:
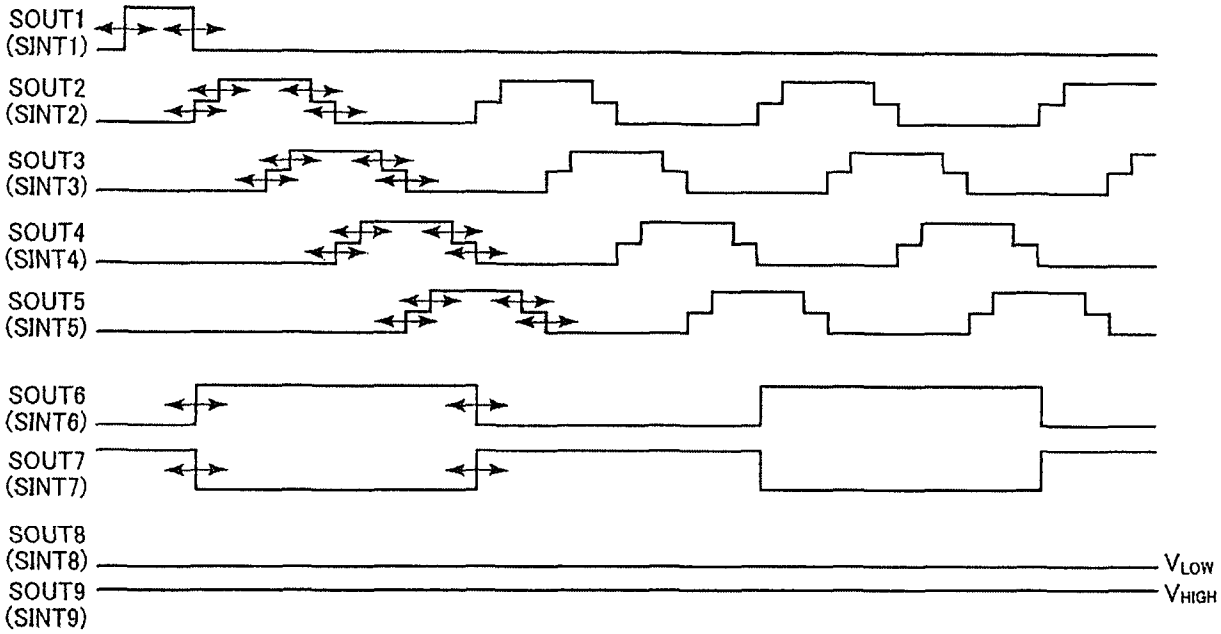
FIG. 11 is a timing chart showing an example of the waveforms of the gate control signals SOUT1 to SOUT9 generated by the source driver IC in the first embodiment.

FIG. 9 to FIG. 11 are timing charts showing examples of the waveforms of the generated gate control signals SOUT1 to SOUT9. In the example of FIG. 9, the internal pulse signal PLS1 is selected as the internal gate control signal SINT1, and the gate control signal SOUT1 having the waveform corresponding to the internal gate control signal SINT1 is supplied to the GIP circuit 6 or the gate driver IC 6A. Even the other internal gate control signals SINT2 to SINT9 are selected from the internal clock signals CLK1 to CLKp and the internal pulse signals PLS1 to PLSq.

In an example of FIG. 10, the internal clock signal CLK2 is selected as the two internal gate control signals SINT3 and SINT5. The gate control signals SOUT3 and SOUT5 having the waveforms corresponding to the internal gate control signals SINT3 and SINT5 are supplied to the GIP circuit 6 or the gate driver IC 6A. In this way, the same signal may be selected as the two internal gate control signals SINT3 and SINT5.

Also, in an example of FIG. 11, the multi-level internal clock signals MCLK1 to MCLK4 are selected as the internal gate control signals SINT2 to SINT5, respectively, and the gate control signals SOUT2 to SOUT5 having the waveforms corresponding to the internal gate control signals SINT2 to SINT5 are supplied to the GIP circuit 6 or the gate driver IC 6A.

Figure 12:
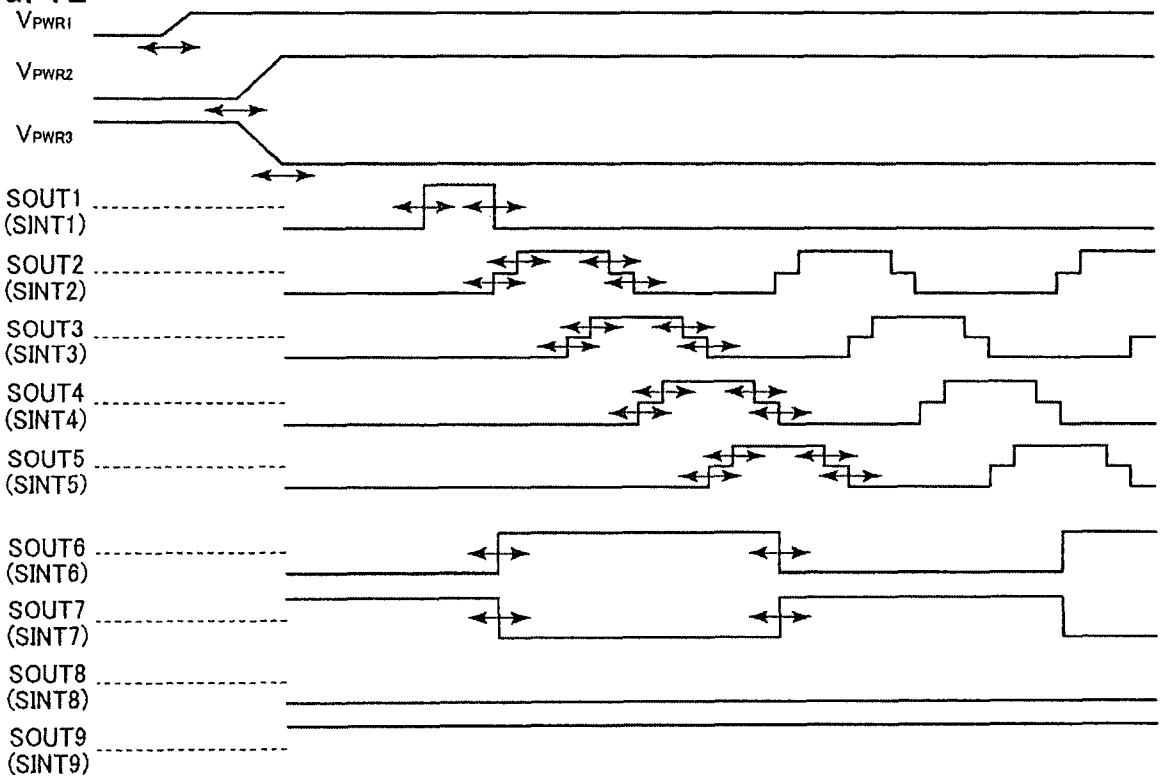
FIG. 12 is a timing chart showing an example of rise timings and fall timings of power supply voltages $V_{PWR1}$ to $V_{PWR3}$ at a time of a startup in the first embodiment.

Here, as shown in FIG. 12, the rising timing and/or falling timing of the power supply voltages (in the present embodiment, power supply voltages $V_{PWR1}$ to $V_{PWR3}$) which are supplied from the LCD drive power supply circuit 17 to the GIP circuit 6 or gate driver IC 6A may be also programmed in software. In this case, the register values to control the rising and falling orders of the power supply voltages $V_{PWR1}$ to $V_{PWR3}$ that are supplied from the LCD drive power supply circuit 17 to the GIP circuit 6 or gate driver IC 6A and a wait time are set in the control register 13. The LCD drive power supply circuit 17 raises or falls the power supply voltages $V_{PWR1}$ to $V_{PWR3}$ on the basis of the register values set in the control register 13.

As explained above, the source driver IC 3 in the present embodiment is configured such that the waveforms of the gate control signals SOUT1 to SOUTn (and the internal gate control signals SINT2 to SINT5) can be programmed in software. According to the thus-configured source driver IC 3, it is possible to generate the gate control signals SOUT1 to SOUTn corresponding to the gate drivers (the GIP circuit or the gate driver IC) whose specifications differ from each other, while miniaturizing the circuit scale.

Note that in the present embodiment, as mentioned above, the 2-valued internal digital signals (namely, the internal clock signals CLK1 to CLKp and the internal pulse signals PLS1 to PLSq) and the multi-level internal digital signals (namely, the multi-level internal clock signals MCLK1 to MCLKr and the multi-level internal pulse signals MPLS1 to MPLSs) are generated by the timing generator 18. However, the multi-level internal digital signal may not be generated if it is not required. In this case, the sub-counters 34 and 35 and the multi-level pulse generators 38 and 39 may not be installed.

Second Embodiment

Figure 13A:
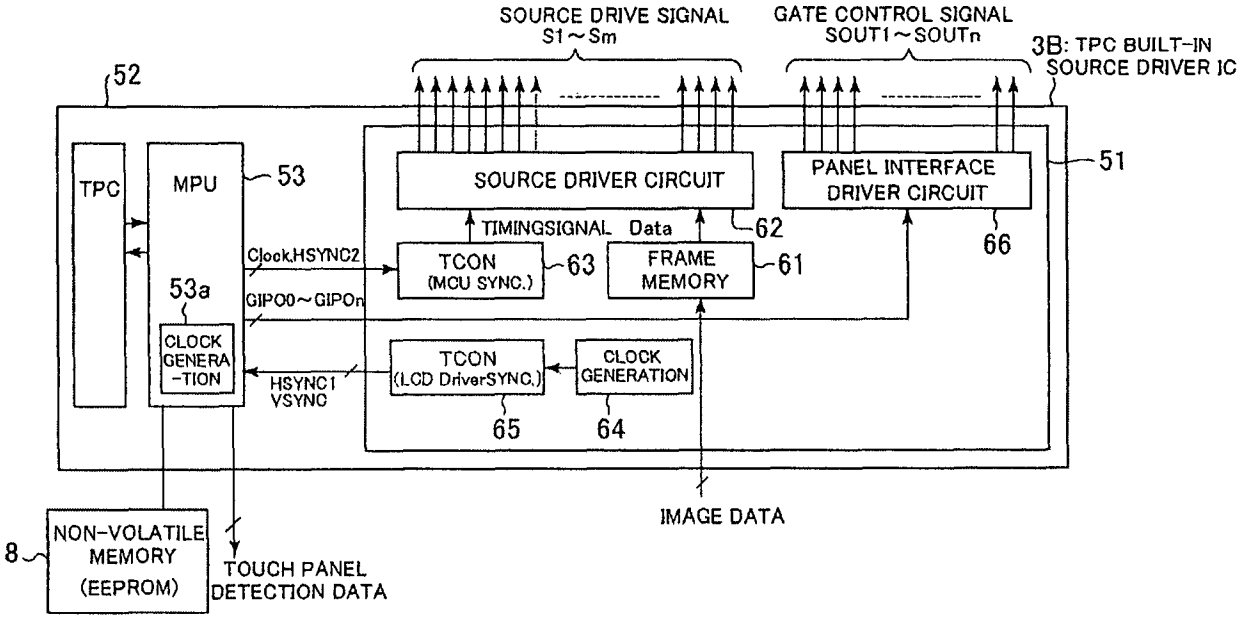
FIG. 13A is a block diagram showing a configuration of a TPC built-in source driver IC in a second embodiment.
Figure 14:
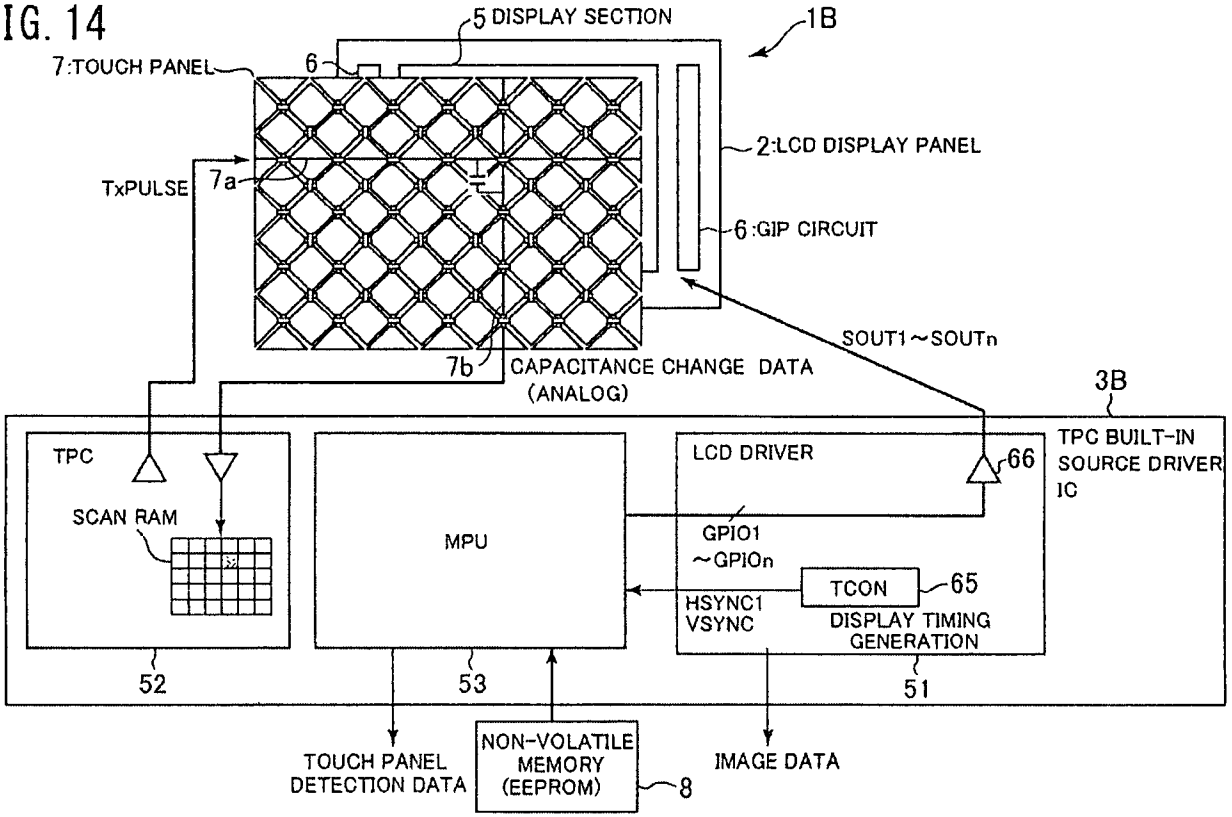
FIG. 14 is a block diagram conceptually showing a configuration of a liquid crystal display apparatus in the second embodiment.

FIG. 13A is a block diagram showing the configuration of the source driver IC according to the second embodiment of the present invention, and FIG. 14 is a block diagram showing the entire configuration of a liquid crystal display apparatus 1B in the second embodiment. In the second embodiment, as shown in FIG. 14, in addition to the liquid crystal display panel 2, a touch panel 7 is mounted on the liquid crystal display apparatus 1B. Also, a function of driving the touch panel 7 and carrying out an operation to detect a contact to the touch panel 7 is installed in the source driver IC. Hereinafter, the source driver IC used in the second embodiment is referred to as a TPC built-in source driver IC 3B. In addition, the non-volatile memory 8 is installed in the liquid crystal display apparatus 1B so as to control an operation of the TPC built-in source driver IC 3B. As the non-volatile memory 8, it is possible to use EEPROM (Electrically Erasable Programmable Read Only Memory). Note that in the configuration of FIG. 14, the liquid crystal display panel 2 in which the GIP circuit 6 is integrated is shown. However, instead of the configuration in which the GIP circuit 6 is integrated in the liquid crystal display panel 2, the gate driver IC 6A may be installed in the liquid crystal display panel 2.

As shown in FIG. 13A, the TPC built-in source driver IC 3B in the present embodiment contains an LCD driver 51, a touch panel controller (TPC) 52 and an MPU (Micro Control Unit) 53. Here, in the present embodiment, attention should be paid to a configuration in which the LCD driver 51, the touch panel controller 52 and the MPU 53 are monolithically integrated into one semiconductor chip.

The LCD driver 51 contains a circuit group for driving the liquid crystal display panel 2, and specifically contains a frame memory 61, a source driver circuit 62, a timing controller 63, a clock generator 64, a timing controller 65 and a panel interface driver circuit 66.

The frame memory 61 and the source driver circuit 62 are a circuit group for driving the source lines formed on the display section 5. The frame memory 61 stores image data supplied from the external apparatus. The source driver circuit 62 generates source drive signals S1 to Sm in response to the image data read from the frame memory 61. The source drive signals S1 to Sm are supplied to the corresponding source lines in the display section 5, respectively, and written to the pixels connected to a gate line selected by the GIP circuit 6 (or the gate driver), through the source lines.

The timing controller 63 receives a clock signal Clock and a horizontal synchronization signal HSYNC2 from the MPU 53 and controls operation timing of the source driver circuit 62 in synchronization with the clock signal Clock and the horizontal synchronization signal HSYNC2.

The clock generator 64 and the timing controller 65 are a circuit group for generating a synchronous signal to synchronize an operation of the MPU 53 with an operation of the LCD driver 51, and specifically, generating a horizontal synchronization signal HSYNC1 and a vertical synchronization signal VSYNC. In detail, the clock generator 64 generates the clock signal used in the LCD driver 51. The timing controller 65 generates the horizontal synchronization signal HSYNC1 and the vertical synchronization signal VSYNC in synchronization with the clock signal generated by the clock generator 64.

The panel interface driver circuit 66 generates the gate control signals SOUT1 to SOUTn and supplies the generated gate control signals SOUT1 to SOUTn to the GIP circuit 6 or gate driver IC 6A. As described later, in the present embodiment, the panel interface driver circuit 66 operates as a level shifting section, which performs a level shift operation on general IO data signals GPIO1 to GPIOn supplied from the MPU 53 so as to match with the signal level of the input of the GIP circuit 6 or gate driver IC 6A and outputs the signals after the level shift as the gate control signals SOUT1 to SOUTn.

Referring to FIG. 14 again, the touch panel controller 52 is a circuit for driving the touch panel 7 and acquiring digital data indicative of an electronic state of the touch panel 7. In the present embodiment, the touch panel controller 52 has a function of each of driving lateral electrode patterns 7*a* of the touch panel 7 and detecting a capacitance between the lateral electrode pattern 7*a* and a longitudinal electrode pattern 7*b*. Here, the lateral electrode patterns 7*a* are electrode patterns that extend in the horizontal direction (first direction) of the touch panel 7, and the longitudinal electrode patterns 7*b* are electrode patterns that extend in the vertical direction (second direction) of the touch panel 7.

Figure 15:
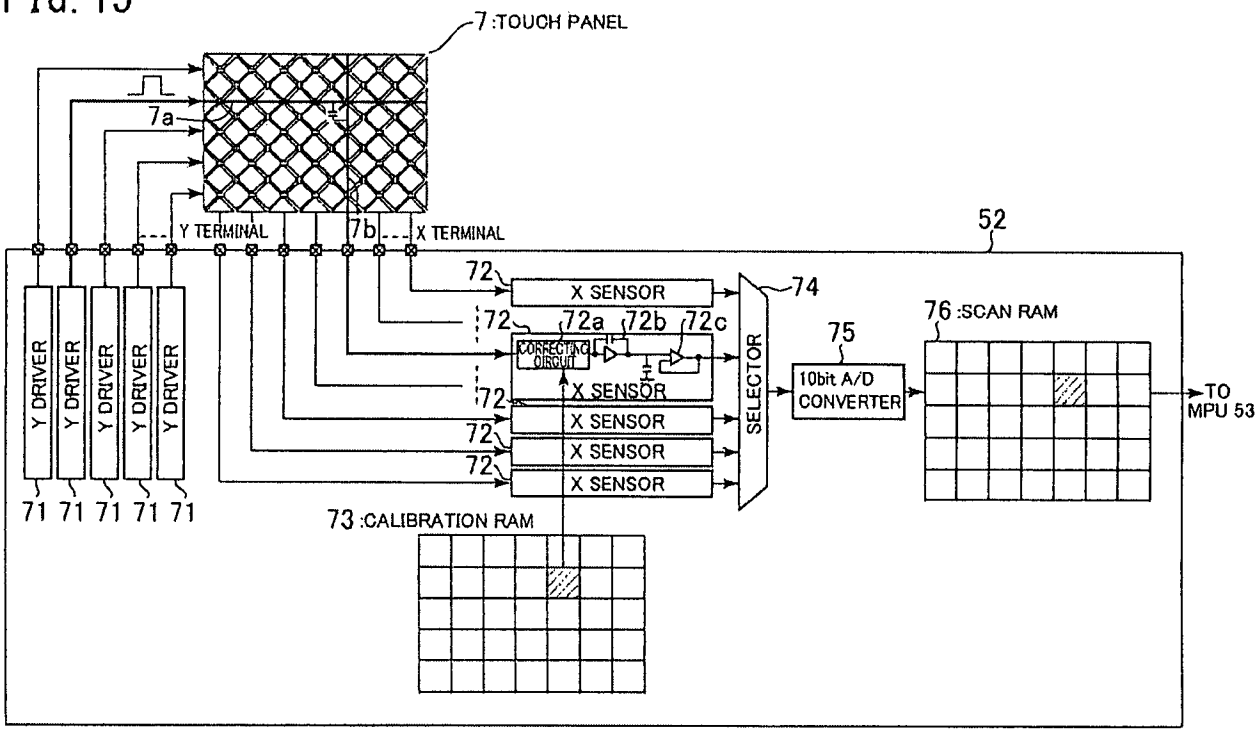
FIG. 15 is a block diagram showing an example of a configuration of a touch panel controller integrated in the TPC built-in source driver IC in the second embodiment.

FIG. 15 is a block diagram showing the detail of the configuration of the touch panel controller 52. The touch panel controller 52 contains Y-drivers 71, X-sensors 72, a calibration RAM 73, a selector 74, an A/D converter 75 and a scan RAM 76.

The Y-drivers 71 are connected to the lateral electrode patterns 7*a*, and supply drive pulses to the connected lateral electrode patterns 7*a*, respectively. Thus, the Y-drivers 71 sequentially supply the drive pulses to the plurality of lateral electrode patterns 7*a*.

The X-sensors 72 are connected to the longitudinal electrode patterns 7*b*, and acquires detection signals which have signal levels corresponding to the voltages of the connected longitudinal electrode patterns 7*b*, respectively. The voltage of each longitudinal electrode pattern 7*b* when the drive pulse is supplied to a certain lateral electrode pattern 7*a* is based on the capacitance between the lateral electrode pattern 7*a* and each longitudinal electrode pattern 7*b*. Thus, by acquiring the detection signal that has the signal level corresponding to the voltage of each longitudinal electrode pattern 7*b*, it is possible to obtain data of the capacitance (capacitance data) between the lateral electrode pattern 7*a* and each longitudinal electrode pattern 7*b*.

More specifically, the X-sensor 72 contains a correcting circuit 72*a*, an integrating circuit 72*b* and a sample holding circuit 72*c*. The correcting circuit 72*a* corrects the acquired detection signal on the basis of calibration data stored in the calibration RAM 73. The integrating circuit 72*b* integrates an output signal of the correcting circuit 72*a*. The sample holding circuit 72*c* samples and holds a voltage generated at an output of the integrating circuit 72*b*.

The calibration RAM 73 stores the calibration data used in the correction by the correcting circuit 72*a* for each of the combinations between the lateral electrode pattern 7*a* and each of the longitudinal electrode patterns 7*b*.

The selector 74 selects one of output signals from the X-sensors 72, and the A/D converter 75 carries out analog-digital conversion on the output signal from the selected X-sensor 72. The scan RAM 76 stores the digital data outputted by the A/D converter 75 as digital capacitance data indicative of the capacitance between the lateral electrode pattern 7*a* and the longitudinal electrode pattern 7*b*.

The capacitance data between a certain lateral electrode pattern 7*a* and each longitudinal electrode pattern 7*b* is acquired as follows. The Y-driver 71 connected to the above lateral electrode pattern 7*a* supplies a drive pulse to the above lateral electrode pattern 7*a*. When the drive pulse is supplied, the capacitance between the above lateral electrode pattern 7*a* and each longitudinal electrode pattern 7*b* is charged so as to generate a voltage in each longitudinal electrode pattern 7*b*. As this result, a detection signal that has a signal level corresponding to the voltage of each longitudinal electrode pattern 7*b* is acquired by the correcting circuit 72*a* in each X-sensor 72. The detection signal acquired by the correcting circuit 72*a* is corrected on the basis of the calibration data stored in a corresponding region of the calibration RAM 73 and sent to the integrating circuit 72*b*. The operation of supplying the drive pulse and the operation of acquiring the detection signal by the X-sensor 72 are carried out a plurality of times. Consequently, the voltage corresponding to the capacitance between the above lateral electrode pattern 7*a* and the above longitudinal electrode pattern 7*b* is generated at the output of the integrating circuit 72*b*. The voltage generated at the output of the integrating circuit 72*b* is acquired by the sample holding circuit 72*c*. Moreover, the selector 74 sequentially selects the output signals of the X-sensors 72 (namely, the output signals of the sample holding circuits 72*c*), and the selected output signal of the X-sensor 72 is supplied to the A/D converter 75. The A/D converter 75 performs the analog-digital conversion on the output signal of the selected X-sensor 72. The digital data obtained by this analog-digital conversion is written as the digital capacitance data into the scan RAM 76. The digital capacitance data written to the scan RAM 76 are sequentially read out to the MPU 53 and used in the processing by the MPU 53.

Referring to FIG. 14 again, the MPU 53 has a function of acquiring the digital data indicating the electronic state of the touch panel 7, from the touch panel controller 52 and detecting the contact of a physical body to the touch panel 7 from the digital data. In the present embodiment, the MPU 53 reads the digital capacitance data from the scan RAM 76 of the touch panel controller 52 and calculates the coordinates of the contact point with the physical body (for example, a finger of a user) on the touch panel 7. Moreover, the MPU 53 detects a touch operation to the touch panel 7 (namely, the operation to the touch panel 7 carried out by the user) from the calculated coordinates of the touch panel 7 and generates touch panel detection data indicating a manner of the detected touch operation.

In order to improve the stability of detection of the touch operation, the LCD driver 51 and the MPU 53 exchange timing control signals with each other. As mentioned above, the timing controller 65 of the LCD driver 51 transmits the horizontal synchronization signal HSYNC1 and the vertical synchronization signal VSYNC to the MPU 53. On the other hand, the MPU 53 transmits the clock signal Clock and the horizontal synchronization signal HSYNC2 to the LCD driver 51. The clock signal Clock is generated by a clock generator 53*a* of the MPU 53.

Figure 13B:
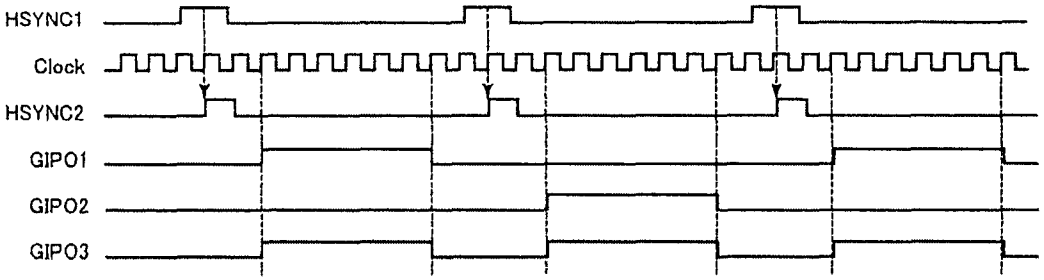
FIG. 13B is a timing chart showing an example of a waveform of a signal exchanged between an MPU (Micro Processing Unit) and an LCD driver (Liquid Crystal Display) driver in the TPC built-in source driver IC in the second embodiment.

FIG. 13B shows the timings of the horizontal synchronization signal HSYNC1 generated by the timing controller 65 of the LCD driver 51 and the clock signal Clock and the horizontal synchronization signal HSYNC2 that are generated by the MPU 53. The clock generator 53*a* in the MPU 53 generates the clock signal Clock in synchronization with the horizontal synchronization signal HSYNC1 received from the timing controller 65. The MPU 53 further generates the horizontal synchronization signal HSYNC2 in synchronization with the clock signal Clock and supplies the clock signal Clock and the horizontal synchronization signal HSYNC2 to the LCD driver 51.

The MPU 53 recognizes a timing when drive noise of the liquid crystal display panel 2 is generated, from the horizontal synchronization signal HSYNC1 and the vertical synchronization signal VSYNC that are supplied by the LCD driver 51. In case of generation of the touch panel detection data, the MPU 53 detects the manner of the touch operation to the touch panel 7 in consideration of the timing when the drive noise is generated and consequently generates the touch panel detection data indicating the detection result.

Referring to FIG. 13A again, one feature of the TPC built-in source driver IC 3B in the present embodiment is in that the waveforms of the gate control signals SOUT1 to SOUTn are generated by using the MPU 53 which is used to generate the touch panel detection data. The MPU 53 has a high function of allowing the detection of the manner of the touch operation. Therefore, in the present embodiment, the function of the MPU 53 is used to generate the waveforms of the gate control signals SOUT1 to SOUTn in software.

In detail, the waveform data indicating the waveforms of the gate control signals SOUT1 to SOUTn are set in the non-volatile memory 8. The MPU 53 generates the general IO data signals GPIO1 to GPIOn on the basis of the waveform data. Here, the general IO data signals GPIO1 to GPIOn are signals of the data sequences corresponding to the waveforms of the desirable gate control signals SOUT1 to SOUTn. In the present embodiment, the general IO data signals GPIO1 to GPIOn are used as the internal gate control signals that serve as the sources of the gate control signals SOUT1 to SOUTn. In detail, the general IO data signal GPIOi becomes a first value (for example, data of "1") at a timing when the general IO data signal GPIOi should be set to the high level, and becomes a second value (for example, data of "0") that is complementary to the first value at a timing when the general IO data signal GPIOi should be set to the low level. The general IO data signals GPIO1 to GPIOn are generated in synchronization with the above clock signal Clock.

The general IO data signals GPIO1 to GPIOn are supplied to the panel interface driver circuit 66. The panel interface driver circuit 66 performs the level shift operation on the general IO data signals GPIO1 to GPIOn to make those signals match with the signal level of the input of the GIP circuit 6 or gate driver IC 6A, and outputs the signals after the level shift as the gate control signals SOUT1 to SOUTn.

The TPC built-in source driver IC 3B in the present embodiment can generate the general IO data signals GPIO1 to GPIOn having the desirable waveforms, namely, the gate control signals SOUT1 to SOUTn having the desirable waveforms, by suitably setting the waveform data of the non-volatile memory 8. That is, even in the TPC built-in source driver IC 3B in the present embodiment, the waveforms of the gate control signals SOUT1 to SOUTn can be programmed in software.

Figure 16:
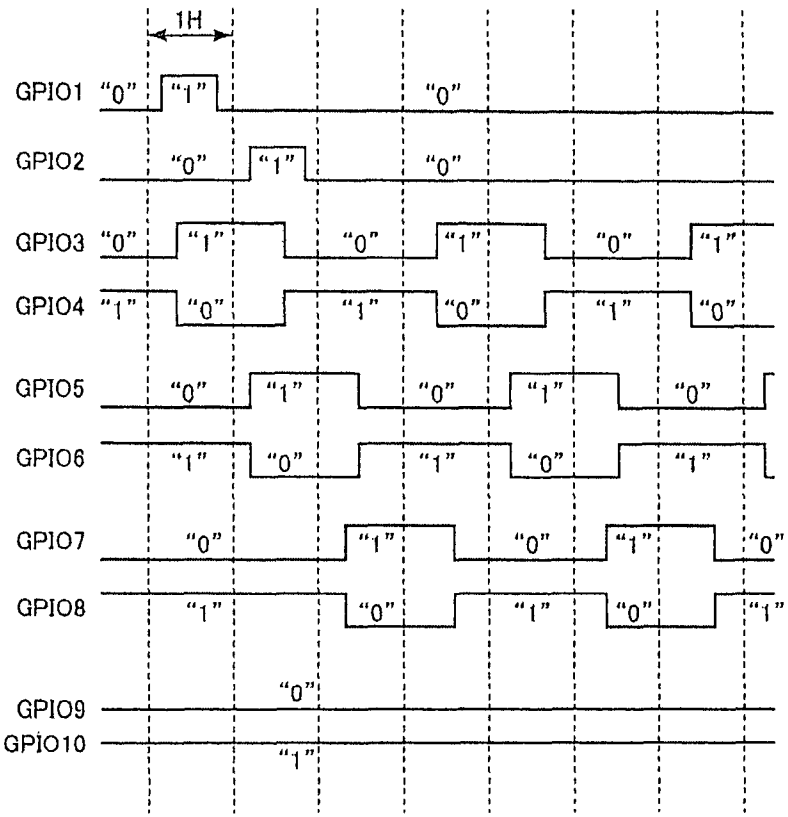
FIG. 16 is a timing chart showing an example of a waveform of a general IO data signal generated by the MPU in the TPC built-in source driver IC in the second embodiment.
Figure 17:
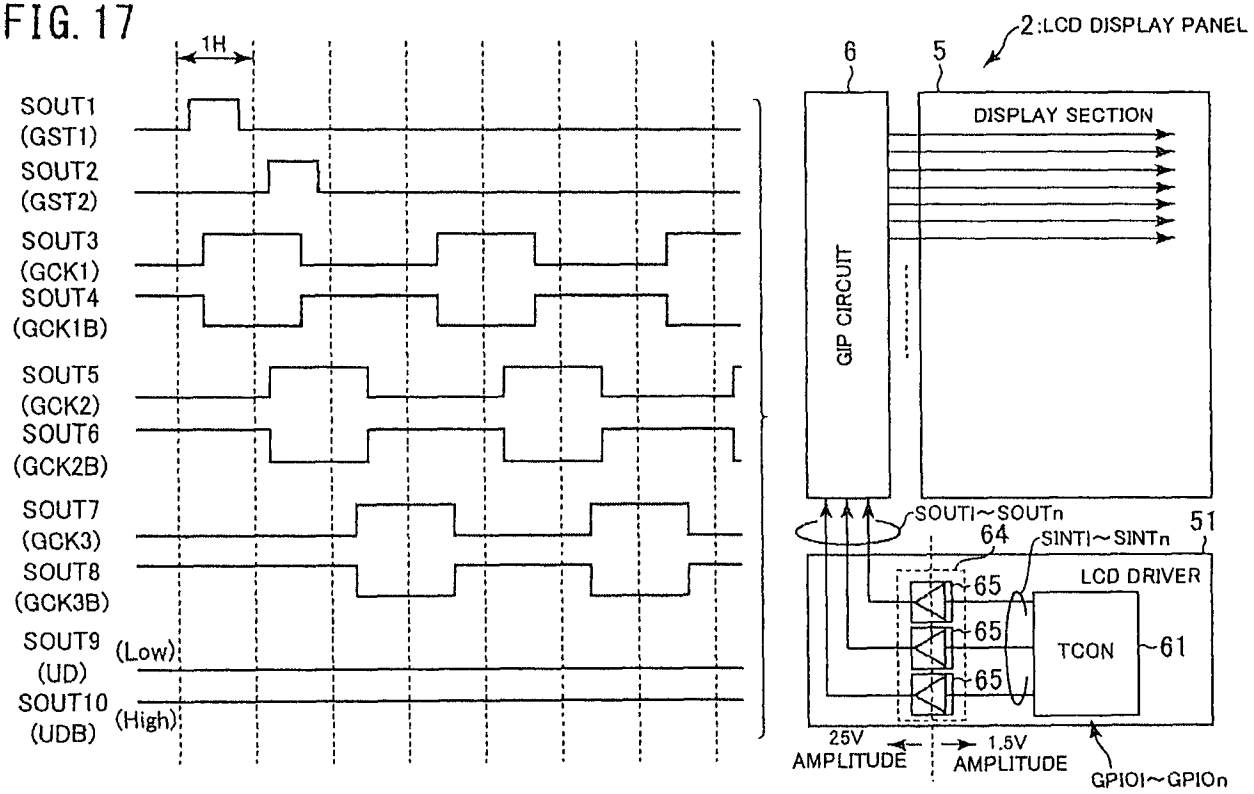
FIG. 17 is a timing chart showing an example of the waveforms of the gate control signals SOUT1 to SOUT10 generated by the TPC built-in source driver IC in the second embodiment.

FIG. 16 shows an example of the data sequences of the general IO data signals GPIO1 to GPIOn generated by the MPU 53, and FIG. 17 shows an example of the gate control signals SOUT1 to SOUTn generated in response to the general IO data signals GPIO1 to GPIOn.

The MPU 53 sets the general IO data signal GPIOi to the data of "1" at the timing when the gate control signal SOUTi should be set to the high level, and sets the general IO data signal GPIOi to the data of "0" at the timing when the gate control signal SOUTi should be set to the low level. The gate control signals SOUT1 to SOUTn are generated as the signals having signal amplitudes different from each other, although having the same waveforms as the general IO data signals GPIO1 to GPIOn, respectively. The data sequences (namely, the waveforms) of the general IO data signals GPIO1 to GPIOn are determined on the basis of the waveform data set in the non-volatile memory 8. That is, the general IO data signals GPIO1 to GPIOn can be programmed on the basis of the waveform data set in the non-volatile memory 8. This implies that the waveforms of the gate control signals SOUT1 to SOUTn can be programmed.

As mentioned above, the TPC built-in source driver IC 3B in the present embodiment is configured such that the waveforms of the gate control signals SOUT1 to SOUTn (and the general IO data signals GPIO1 to GPIOn used as the internal gate control signals) can be programmed in software style. According to the source driver IC 3 having such a configuration, it is possible to generate the gate control signals SOUT1 to SOUTn corresponding to the gate drivers (the GIP circuit or gate driver IC) whose specifications differ from each other, while reducing the circuit scale.

It should be noted that in the present embodiment, the waveforms of the gate control signals SOUT1 to SOUTn are generated by use of the MPU 53 which is used to detect the manner of the touch operation. However, the waveforms of the gate control signals SOUT1 to SOUTn may be generated by use of any processor (MPU or CPU) that is monolithically integrated in the source driver IC. However, as described in the present embodiment, it is possible to generate the gate control signals SOUT1 to SOUTn with a small scale of hardware circuit by use of the MPU 53 used to detect the manner of the touch operation.

As mentioned above, the specific embodiments and examples of the present invention have been described. However, the present invention should not be construed to be limited to the above-mentioned embodiments and examples. A matter that the present invention can be embodied together with various modifications would be self-evident for one skilled in the art. In particular, the above-mentioned explanations describe the embodiments of the liquid crystal display apparatus. However, attention should be paid to a fact that the present invention can be applied to a different panel display apparatus (for example, a display apparatus which uses an organic EL display panel or a plasma display panel).

What is claimed is:

1. A display apparatus, comprising:

a display panel comprising gate lines and source lines;

a gate driver configured to drive each of the gate lines; and a source driver configured to drive each of the source lines, wherein said source driver comprises a gate control signal generator configured to generate a gate control signal to control said gate driver, wherein said gate control signal generator comprises:

a waveform control register;

an internal digital signal generator configured to generate a plurality of multi-level internal digital signals, whose waveforms are different from each other, in response to a first register value held by said waveform control register, each of the multi-level internal digital signals including a 3-valued or more digital signal;

a pulse swap circuit configured to output an internal gate control signal generated from the plurality of multi-level internal digital signals, the internal gate control signal including a digital signal; and a level shifter connected between the gate driver and the pulse swap circuit and configured to perform a level shift on the internal gate control signal to generate the gate control signal, and wherein said pulse swap circuit is responsive to a second register value held by said waveform control register for outputting as the internal gate control signal a signal selected from the plurality of multi-level internal digital signals or a signal generated by performing a logical operation on a plurality of signals selected from internal digital signals including the plurality of multi-level internal digital signals.

2. The display apparatus according to claim 1, wherein a period and phase of each of the plurality of multi-level internal digital signals are adjusted based on the first register value held by said waveform control register.

3. A display apparatus, comprising:

a display panel comprising gate lines and source lines;

a gate driver configured to drive each of the gate lines; and a source driver configured to drive each of the source lines, wherein said source driver comprises a gate control signal generator configured to generate a gate control signal to control said gate driver, wherein said gate control signal generator is configured to allow a waveform of the gate control signal to be controlled by software, wherein said gate control signal generator comprises:

a waveform control register;

a first internal digital signal generator configured to generate a plurality of internal digital signals, whose waveforms are different from each other, in response to a first register value held by said waveform control register;

a second internal digital signal generator configured to generate a plurality of multi-level internal digital signals different in waveform from each other in response to a second register value held by said waveform control register;

a pulse swap circuit configured to output an internal gate control signal generated from the plurality of internal digital signals and the plurality of multi-level internal digital signals; and a level shifter configured to perform a level shift on the internal gate control signal to generate the gate control signal, wherein said pulse swap circuit is responsive to a third register value held by said waveform control register for outputting as the internal gate control signal a signal selected from the plurality of internal digital signals and the plurality of multi-level internal digital signals or a signal generated by performing a logical operation on a plurality of signals selected from the plurality of internal digital signals and the plurality of multi-level internal digital signals.

4. A display panel driver, comprising:

a source driver circuit section configured to drive source lines of a display panel; and a gate control signal generating section configured to generate a gate control signal to control a gate driver which drives a gate line of said display panel, wherein said gate control signal generator comprises:

a waveform control register;

an internal digital signal generator configured to generate a plurality of multi-level internal digital signals, whose waveforms are different from each other, in response to a first register value held by said waveform control register, each of the multi-level internal digital signals including a 3-valued or more digital signal;

a pulse swap circuit configured to output an internal gate control signal generated from the plurality of multi-level internal digital signals, the internal gate control signal being a digital signal; and a level shifter connected between the gate driver and the pulse swap circuit and configured to perform a level shift on the internal gate control signal to generate the gate control signal, and wherein said pulse swap circuit is responsive to a second register value held by said waveform control register for outputting as the internal gate control signal a signal selected from the plurality of multi-level internal digital signals or a signal generated by performing a logical operation on a plurality of signals selected from the plurality of multi-level internal digital signals.

5. The display panel driver according to claim 4, wherein a period and a phase of each of the plurality of multi-level internal digital signals are controlled based on the first register value held by said corrugated control register.

6. A display panel driver, comprising:

a source driver circuit section configured to drive source lines of a display panel; and a gate control signal generating section configured to generate a gate control signal to control a gate driver which drives a gate line of said display panel, wherein said gate control signal generating section is configured to be able to control a waveform of the gate control signal by software, wherein said gate control signal generator comprises:

a waveform control register;

a first internal digital signal generator configured to generate a plurality of internal digital signals different in waveform from each other in response to a first register value held by said waveform control register;

a second internal digital signal generator configured to generate a plurality of multi-level internal digital signals different in waveform from each other in response to a second register value held by said waveform control register, a pulse swap circuit configured to output an internal gate control signal generated from the plurality of internal digital signals and the plurality of multi-level internal digital signals; and a level shifter configured to perform the internal gate control signal on a level shift to generate the gate control signal, wherein said pulse swap circuit is responsive for a third register value held by said waveform control register for outputting as the internal gate control signal a signal selected from the plurality of internal digital signals and the plurality of multi-level internal digital signals, or a signal generated by performing a logic operation of a plurality of signals selected from the plurality of internal digital signals and the plurality of multi-level internal digital signals.

* * * * *